United States Patent [19]

Boisvert et al.

[11] 4,451,510

[45] May 29, 1984

[54] AUTOMATIC ARTIFICIAL TREE

[75] Inventors: Pierre U. Boisvert, Granby; Jean-Daniel Bapst, Ste-Cécile de Milton, both of Canada

[73] Assignee: Barcana Ltee, Quebec, Canada

[21] Appl. No.: 352,590

[22] Filed: Feb. 26, 1982

[30] Foreign Application Priority Data

Jan. 18, 1982 [CA] Canada ..... 394375

[51] Int. Cl.[3] ..... A47G 33/06

[52] U.S. Cl. ..... 428/8; 428/20

[58] Field of Search ..... 428/8, 18, 19, 20, 9, 428/27

[56] References Cited

U.S. PATENT DOCUMENTS

| | | | |
|---|---|---|---|
| 1,694,974 | 12/1928 | Glover | 428/8 |
| 3,030,720 | 4/1962 | Osswald et al. | 428/8 |
| 3,115,435 | 12/1963 | Abramson | 428/8 |
| 3,214,318 | 10/1965 | Snow | 428/8 |
| 3,616,107 | 10/1971 | Kershner | 428/20 X |
| 3,813,277 | 5/1974 | Kleiman | 428/20 X |
| 3,928,689 | 12/1975 | Mottel | 428/20 X |
| 3,959,536 | 5/1976 | Chase | 428/20 X |
| 3,970,834 | 7/1976 | Smith | 428/20 X |
| 4,093,758 | 6/1978 | Weskamp et al. | 428/20 X |
| 4,140,823 | 2/1979 | Weskamp | 428/20 X |

FOREIGN PATENT DOCUMENTS

| | | | |
|---|---|---|---|
| 1035141 | 7/1978 | Canada | 428/8 |

*Primary Examiner*—Henry F. Epstein

*Attorney, Agent, or Firm*—Larson and Taylor

[57] ABSTRACT

An automatic artificial Christmas tree using an improved one-piece plastic molded branch holding ring and spacer combination for use with twisted wire stem branches or other suitable metal wire branches without the need to resort to individual branch attaching connectors. According to the disclosed method of assembly, the branches used have a straight wire stem. The stem of each branch is first inserted into a branch receiving radial slot of a branch holder. Its free end is then raised upwardly from the horizontal position to the vertical or beyond to form a hook for pivotally connecting the branch to the holder.

10 Claims, 6 Drawing Figures

AUTOMATIC ARTIFICIAL TREE

BACKGROUND OF THE INVENTION

This invention relates to an improved artificial tree, in particular to Christmas synthetic trees of the automatic type.

Artificial trees have become increasingly popular during recent years. However, automatic artificial trees remain relatively expensive. They consist of a main body and of a top portion telescopingly engaged into the pole of the main body. The branches of the main body are retained to the pole by various pivoting means which permit upwards folding of the branches along the pole for more compact storage. A few prior automatic artificial tree designs are disclosed in the following U.S. Pat. No. 1,694,974 dated Dec. 11, 1928 to GLOVER; U.S. Pat. No. 3,115,435 dated Dec. 24, 1963 to ABRAMSON; U.S. Pat. No. 3,616,107 dated Oct. 26, 1971 to KERSHNER; U.S. Pat. No. 3,928,689 dated Dec. 23, 1975 to MOTTEL; and U.S. Pat. No. 4,140,823 dated Feb. 20, 1979 of WESKAMP.

An object of this invention is to provide an automatic artificial tree construction which is susceptible of wide consumer acceptance on account of better aesthetic value easier handling and storage and lower overall cost. An other object of this invention is to provide an automatic tree construction which greatly facilitates installation of the branches at the point of assembly.

SUMMARY OF THE INVENTION

Broadly stated, this invention provides an improved automatic artificial tree which has a plurality of intermediate and lower branches pivotally secured to trunk means with the use of improved branch holders.

In accordance with a feature of the invention, the branch holders are specifically designed to permit bending of the inner end of the stem of every branch to form an angular hook which becomes a captive pivotal connection of the branch to the receiving holder once the holder is in place on the tree's vertical support hole.

The branch holder in use can receive a comparatively large number of branches; to this end it has a series of radially extending branch receiving slots, preferably as many as twelve. Angular positioning means is also provided which sets the angular relationship of each branch holder with respect to the adjacent branch holders. Preferably, the angular positioning means offers the choice between two positions: vertical alignment of the branches of adjacent layers thereof and alignments of the branches in alternate layers only. It is also contemplated to use one-piece plastic molded branch holders with integral spacers. The type of branches used is not critical; the preferred one being twisted wire branches having a bare, straight inner end and supporting synthetic evergreen needles made of any suitable flame retardant material, for example, polyvynilchloride.

Using the technique of this invention, automatic artificial Christmas trees are being made which, surprisingly, look like natural Christmas trees, to the point of actual confusion. Yet, the manufacturing cost of such embodiments of this invention remains very low on account of the ease of manual assembly by unskilled labour, the use of cheap wire twisted branches in large numbers if desired, without fittings for the pivotal connection, and by means of mass produced plastic branch holders. The invention therefore provides a novel method of assembly of automatic artificial Christmas trees using hook forming branch holders.

BRIEF DESCRIPTION OF THE DRAWINGS

These and other features and advantages will become more apparent from the following detailed description of a preferred embodiment of this invention in connection with the accompanying drawings wherein.

DESCRIPTION OF A PREFERRED EMBODIMENT

Figure 1:
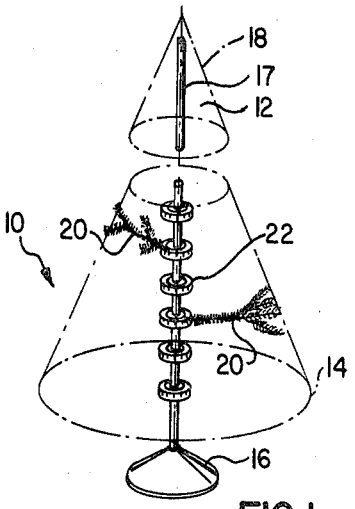
FIG. 1 is a diagrammatic illustration of an automatic artificial tree standing on a base support.

With reference to the drawings, particularly FIG. 1 thereof, the illustrated embodiment of an automatic artificial tree 10 comprises a top section 12, a main section 14 and a base support 16 for maintaining main section 14 in upright position. Top section 12 comprises a central pole 17 to which are secured a large number of outwardly extending branches (not shown) to form a relatively small conical head as illustrated by the dotted line 18 which shows the general outline of top section 12. Normally the branches forming top section 12 are rigidly secured to pole 17 and consequently the assembly is not collapsible.

Main section 14, however, is constructed with a plurality of outwardly extending branches 20 (only 2 of which being shown in FIG. 1) pivoted to a plurality of branch holders 22. The pivotal connection of each branch 20 to its branch holder 22, which will be described herein below in greater detail, allows the branches 20 to extend radially outwardly in the horizontal direction when main section 14 is held in normal upright position, but when main section 14 is turned upside down, branches 20 are free to fold along tubular pole 23 to which the various branch holders 22 are mounted in a coaxial nesting relationship. For relatively small automatic artificial trees, main section 14 is made of one assembly but for taller embodiments, for example, for trees measuring six feet in height or more, main section 14 is preferably made as two or more assemblies each of which having its own tubular pole 23 and a predetermined number of branch holders 22 in position thereon, the successive tubular poles 23 engaging one another with a suitable male-female engagement (not shown).

Figure 2:
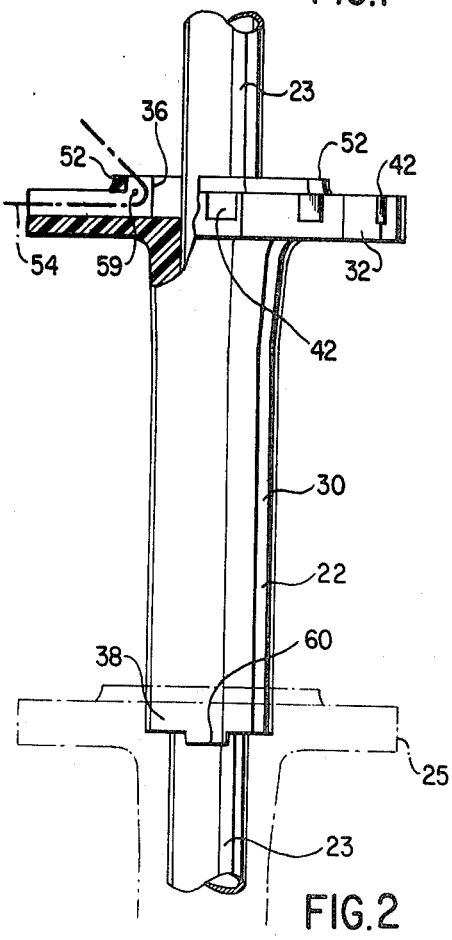
FIG. 2 is an elevational view of a branch holder on a support pole, the left hand side portion of the branch holder being shown in cross-section along line II of FIG. 3.

In FIG. 2, a branch holder 22 is illustrated in elevational view, on a tubular pole 23, and dotted lines 25 are used to show the outline of the upper part of a branch holder immediately below in coaxial nesting relationship on tubular pole 23. Branch holder 22 comprises a spacer 30 and integrally formed branch holding ring 32 which is in the form of a relatively thick disc-shaped enlargement at the upper end of spacer 30. This hollow branch holder 22 comprises a longitudinally extending hole 34 for receiving tubular pole 23 therein with a limited amount of play.

A nesting socket 36 is provided on the upper surface of branch holding ring 32 for receiving the lower end 38 of spacer 30 as will be further described hereinafter. A plurality of radially extending branch receiving slots 42 on the upper surface of branch holding ring 32 extend from the outer surface 44 thereof to the nesting socket 36, and these branch receiving slots 42 are relatively deep so as to provide adequate lateral support to branches 20 therein, one of which being shown in FIG. 3. Preferably, the various branch receiving radial slots 42 are contained in a common plane which extends parallel to the body 32, which plane (not shown) also comprises the bottom surface 47 of nesting socket 36.

A fulcrum ring 52 formed integrally of branch holding ring 32 bridges every branch receiving slot 42 a sufficient distance outwardly from nesting socket 36 so as to allow branch 20 to extend there between as shown in FIG. 2 by phantom line 54. In addition, laterally confining means 56 must be provided on each side of every branch receiving radial slot 42 inwardly of fulcrum ring 52 in order to properly retain the upwardly bent tip 57 of the stem of branches 20. In effect, laterally confining means 56 consists of two upwardly extending walls between which tip 57 extends, and these walls, of which one is shown at 59 in FIG. 2, should be sufficiently close to one another in order to prevent excessive rotation of branch 20 around the axes of the stem thereof.

Figure 3:
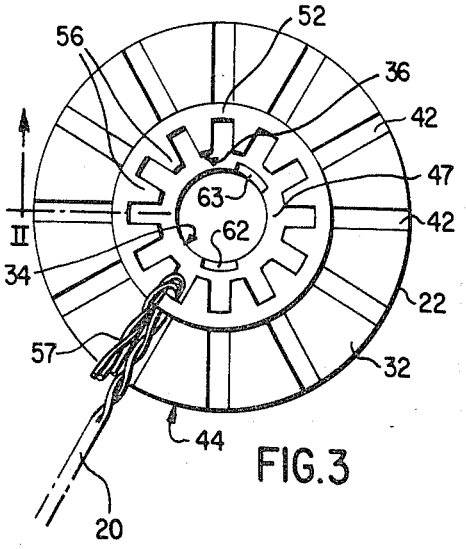
FIG. 3 is a top view of the branch holding ring seen in FIG. 2.

In order to determine the relative angular position of the branch receiving radial slot 42 in successive branch holders 22, an angular positioning tab 60 (see FIG. 2) is provided at the lower end of branch holder 22 with complementary tab receiving sockets 62 and 63 disposed in the bottom surface 47 of nesting socket 36 as illustrated in FIG. 3. Tab receiving socket 62 is so positioned in relation to the branch receiving radial slots 42 as to ensure vertical alignment of the branches in every successive layer of branches, whereas tab receiving socket 63 is located between two successive branch receiving radial slots 42 (see FIG. 3) in order to ensure vertical alignment of branches 20 of every alternate layer thereof for a better distribution of branches in main section 14.

Figure 4:
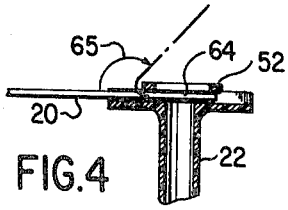
FIG. 4 is a simplified cross-sectional view of a branch holder illustrating the position of the inner end of the stem of a branch prior to bending of the tip thereof.
Figure 5:
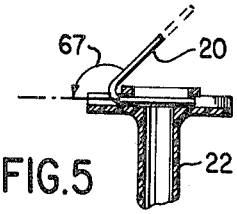
FIG. 5 is a cross-sectional view corresponding to that of FIG. 4 but showing the stem of the branch once bent.
Figure 6:
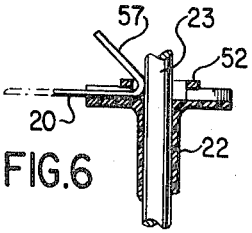
FIG. 6 is a cross-sectional view similar to the views of FIGS. 4 and 5 but with the support pole in position for confining the inner end of the branch.

In accordance with a feature of this invention, the branch holder provides an extremely convenient means for the installation of branches 20 to holders 22, and FIGS. 4, 5 and 6 are provided in order to more clearly illustrate the method in question. With reference to FIG. 4, the inner end 64 of the stem of branch 20 is inserted sufficiently deeply into one of the branch receiving radial slots 42, and it is then raised upwardly along arrow 65 to a position beyond the vertical whereby to form, with tip 64 an acute angle of between 45 and 60 degrees. This bending of the stem of branch 20 is effected easily be hand without any tools, and fulcrum ring 52 must be constructed with sufficient strength in order to withstand this bending operation. As shown in FIG. 5, the next step involves returning the stem of branch 20 to the horizontal position along arrow 67 and this causes tip 57 to assume the position illustrated in FIG. 6. At that point the process is repeated until a sufficient number of branches 20 have been mounted to holder 22 after which holder 22 with branches 20 thereon are mounted to tubular pole 23 which in effect locks the inner ends 57 of branches 20 to their respective branch holders 22. When a successive branch holder 22 will have been mounted to tubular pole 23 with its lower end 38 in position within nesting socket 36, the lower end 38 of this last mentioned holder 22 will in effect further restrict movement of the bent portion 57 of every branch 20 without however preventing folding of such branches around fulcrum ring 52 for compact storage.

When a sufficient number of branch holders 22 with their branches 20 in position thereon has been placed on tubular pole 23 as to complete main section 14, suitable collars (not shown) are used to retain the lowermost one and the uppermost one of branch holders 22 in relatively tight position to tubular pole 23, and this terminates the assembly of main section 14. The type of means used to secure the branch holders 22 to pole 23, as noted above, is not critical although clamping rings have been found quite suitable.

Branch receiving radial slots 42 should extend in straight line and be sufficiently deep as to completely receive the portion of the stem of the associated branch 20 which is adjacent tip 57 thereof, and they should be sufficiently long as to prevent excessive lateral play of branch 20. The number of branch receiving slots 42 should preferably exceed six and may reach twelve. Twelve slots 42 for each holder 22 has been found to be a satisfactory number thereof although the exact number of slots 42 is not critical.

The choice of branches 20 is optional. The preferred type is that using twisted wire stem with evergreen needles secured there between and made of a suitable flame retardant material such as PVC.

While numerous details of construction have been described and specified, it is to be understood that the scope of the invention is defined in the appended claims.

I claim:

1. An automatic artificial tree comprising at least one main section, said main section comprising vertically extending support means, a plurality of branch holders of hollow construction mounted to said support means, coaxially thereof, a plurality of branches pivoted to said branch holders for projecting radially and generally perpendicularly of said support means when said main section is in its normal upright position but free to fold to a collapsed position generally parallel to said support means when said main section is upside-down, each branch holder comprising a branch holding ring and a tubular spacer, depending from said ring in fixed relationship thereto, each branch holding ring comprising a generally planar disc-shaped body of rigid material, with a central hole for including said support means, a coaxial fulcrum ring on the upper surface of said disc-shaped body, a plurality of radially extending branch receiving slots on said upper surface below said fulcrum ring, said slots having laterally confining means, each branch having the tip of its inner end bent upwardly behind said fulcrum ring at such an angle that upon movement of the tree to an upright position, the bent inner end is free to swing down about the fulcrum ring until the branch rests in its respective slot.

2. An automatic artificial tree as defined in claim 1, including a top section separate from the said main section and means for attaching the top section to the top of the main section or sections.

3. An automatic artificial tree as defined in claim 1, said support means comprising an elongate vertically extending support pole, the said branch holders being coaxially mounted on said support pole, the uppermost and lowermost branch holder being secured to the support pole.

4. An automatic artificial tree as defined in claim 1, and including further laterally confining means aligned with each slot and located on the opposite side of the fulcrum from said slot, said further laterally confining means having a pair of opposed vertically extending surfaces for guiding the bent part of a branch.

5. An automatic artificial tree as defined in any one of claims 1, 3 or 4, wherein said radially extending branch receiving slots are relatively deep and extend in straight line from the outer edge of said disc-shaped body, parallel to the plane thereof, radially inwardly, thereby to completely receive the portion of the stem of the associated branch which is adjacent to the tip thereof, said slot being sufficiently long as to prevent excessive lateral movement of said branch when supported in said slot.

6. An automatic artificial tree as defined in claim 5 wherein each branch holder comprises a number of said branch receiving slots comprised between six and twelve.

7. An automatic artificial tree as defined in claim 6 wherein said branch holding ring and said spacer in each of said branch holders are integrally formed, each branch holder being a one-piece plastic molded component with an integrally formed fulcrum ring.

8. An automatic artificial tree as defined in claim 7 wherein in branch holder comprises a coaxial nesting socket on the upper surface of its branch holding ring, said nesting socket receiving the lower end of the spacer of the branch holder disposed immediately above it and conforming generally to the shape thereof, each of said branch receiving slots opening at said nesting socket.

9. An automatic artificial tree as defined in any one of claims 1, 3 or 4 wherein each branch holder comprises indexing means for determining the angular relationship of successive branch holders in nesting relationship on said support means, said indexing means comprising a projecting tab at one end of each branch holder, and two angularly spaced apart tab receiving sockets, the position of one tab receiving socket relative to the other being such as to offer a choice between vertical alignment of the branch receiving slots of successive branch holders, on the one hand, and vertical alignment of the branch receiving slots of alternate branch holders, on the other.

10. In an automatic artificial tree, a plurality of vertically nested branch holders mounted to a common support pole, each branch holder being a one-piece plastic molded component and having a tubular spacer and a branch receiving ring at the upper end of said spacer, said branch receiving holder consisting of a relatively thick disc-shaped portion having a central aperture in communication with the central hole of its spacer, a coaxial nesting socket for receiving the lower end of the spacer of a branch holder, if any, directly thereabove, about twelve radially extending branch receiving slots into said disc-shaped body, extending to a common plane which contains the bottom surface of said nesting socket, an integral fulcrum ring bridging said branch receiving slots a sufficient distance outwardly of said support pole, each branch holder also having laterally confining means between said fulcrum ring and said nesting socket, said laterally confining means presenting two vertically extending surfaces at the inner end of every branch receiving slot, said automatic artificial tree also comprising a plurality of branches pivotally connected to said branch holders, each branch having a metal wire stem whose inner tip is bent upwardly behind said fulcrum ring between said laterally confining means to form and acute angle with the adjacent portion of said stem.

* * * * *